US005883938A

United States Patent [19]

Gerth et al.

[11] Patent Number: 5,883,938

[45] Date of Patent: Mar. 16, 1999

[54] X-RAY RADIATOR WITH AN EXTERIOR, FULLY REMOVABLE, RADIATION PROTECTIVE CLADDING

[75] Inventors: Heinz Gerth, Nuremberg; Dieter Sauer, Fuerth, both of Germany

[73] Assignee: Siemens Aktiengesellschaft, Munich, Germany

[21] Appl. No.: 887,474

[22] Filed: Jul. 2, 1997

[30] Foreign Application Priority Data

Jul. 2, 1996 [DE] Germany ..... 196 26 633.5
May 27, 1997 [DE] Germany ..... 197 22 169.6

[51] Int. Cl.[6] ..... H01J 35/16
[52] U.S. Cl. ..... 378/203; 378/210
[58] Field of Search ..... 378/203

[56] References Cited

U.S. PATENT DOCUMENTS 2,049,275 7/1936 Simon .
4,127,776 11/1978 Pickel ..... 378/203
4,795,654 1/1989 Teleki .
4,852,141 7/1989 Horn ..... 378/203

FOREIGN PATENT DOCUMENTS

OS 44 29 910 7/1995 Germany .

*Primary Examiner*—Craig E. Church
*Attorney, Agent, or Firm*—Hill & Simpson

[57] ABSTRACT

An X-radiator has a housing containing an X-ray tube and a radiation protective cladding containing at least one protective substance. The radiation protection cladding is formed by a jacket that surrounds the housing at its exterior and can be completely removed from the housing.

10 Claims, 2 Drawing Sheets

X-RAY RADIATOR WITH AN EXTERIOR, FULLY REMOVABLE, RADIATION PROTECTIVE CLADDING

BACKGROUND OF THE INVENTION

1. Field of the Invention

The present invention is directed to an X-radiator of the type having a protective housing with an X-ray tube accommodated therein and having a radiation protection layer containing at least one protective substance, i.e., substance which substantially impeded X-ray propagation through the protective layer.

2. Description of the Prior Art

Manufacturers of X-radiators are required to protect the personnel operating radiological systems as well as patients who are examined with radiological systems against excessive radiation exposure during the operation of the radiological system. The protective housing of X-radiators is therefore-provided with a radiation protection lining composed of a protective substance. Protective substances should effect an optimally high attenuation of the X-radiation given an optimally low layer thickness. Baryta stone, concrete, tiles and lead (in the form of metallic lead or lead alloys, lead rubber and lead glass) are standard as protective substances for radiation protection linings in radiology.

In an X-radiator disclosed in German OS 44 29 910, this radiation protection lining is formed by a lead layer arranged in the inside of the protective housing, i.e. a lead lining firmly joined to the inside of the protective housing.

U.S. Pat. No. 2,049,275 discloses that a lead layer be firmly joined to the outside of the protective housing of an X-radiator.

A multi-layer structure of radiation protection layers is known from U.S. Pat. No. 4,795,654.

The application of such lead layers is time-consuming since the lead layer must first be applied to the protective housing and then be soldered or, respectively, welded thereto or connected in some other suitable way.

When, as in the case of German OS 44 29 910, the lead layer is arranged in the inside of the protective housing, there is also the problem that the lead chemically reacts in an undesirable way with the insulating oil that is generally present in the inside of the protective housing. The lead layer must therefore be provided with a protective coat in order to suppress or at least retard the chemical reaction with the insulating oil. Complicated degreasing and coating steps are required in order to assure an adequate adhesion and durability of the protective coating.

Restoration of the protective coat of the lead layer as well as restoration of the outside of the protective housing given recycling of a protective housing returned from a customer is especially problematical given a lead layer arranged in the inside of the protective housing, as in the case of German OS 44 29 910, since the housing and the lead layer must be absolutely de-oiled and degreased for the renewal of the coats.

Although the problem of the reaction of the lead with the insulating oil does not exist given a lead layer applied to the outside of the protective housing, as in the case of U.S. Pat. No. 2,049,275, the risk of mechanical damage to the lead layer, with the consequence or impermissible emergence of radiation, does pose a problem.

Given recycling of protective housings having a lead layer arranged outside the protective housing, as in the case of U.S. Pat. No. 2,049,275, particular care must be exercised to detect damage to the lead layer and to permanently repair it.

SUMMARY OF THE INVENTION

An object of the present invention is to provide an X-radiator of the type initially described such that the radiation protective lead layer can be manufactured in a simple and economic way and which allows an unproblematical recycling.

This object is inventively achieved in an X-radiator having a protective housing, an X-ray tube accommodated therein, and a radiation protective exterior cladding that is formed by a jacket surrounding the protective housing at the outside, containing at least one protective substance and being completely removable from the exterior of the protective housing.

Differing from the known arrangement described above, the radiation protection cladding is not firmly joined to the protective housing, but instead surrounds it in the fashion of a completely removable jacket. By contrast to the known lead layers, thus, the protective substance need not be matched in shape to the frequently complicated shape of the protective housing; rather, largely independently of the shape of the protective housing, the jacket can be given a shape, for example that of an approximately cylindrical pot, that enables a simple manufacture of the jacket.

Since the protective substance is not situated in the inside of the protective housing, the protective coating which is required for known X-radiators with a lead layer applied in the inside can be eliminated, because the protective substance is separated by the protective housing from the insulating oil contained inside the protective housing. On the contrary, a simple coating on the outside of the jacket suffices that need only meet the standard demands in view of corrosion protection and aesthetics.

The outlay for coating the outside of the protective housing is also reduced since this coating can be limited as warranted to those regions of the protective housing that are not covered by the jacket.

Rather substantial advantages are achieved by the invention when recycling X-radiators since it suffices to remove the jacket, check it for the absence of damage, and apply a new coat as required. An important point in this context, compared to known X-radiators with a lead layer applied inside the protective housing, is that waste disposal problems involving oil-contaminated waste are also avoided. It is important compared to known X-radiators with lead layer applied to the outside of the protective housing, that the recycling of X-radiators is substantially simplified because the jacket can be removed, since, after separating the jacket from the protective housing, it is simpler to detect damage to the protective substance and to repair it, if necessary.

In order to assure a releasable attachment of the jacket to the protective housing, the jacket in one embodiment of the invention is formed of a number of parts that are releasably held at the protective housing by holders. The jacket is preferably formed of two half shells. For example, snap connectors or clamp bands can be provided as holders.

If the protective substance, which is preferably lead or a lead alloy or lead rubber, does not exhibit adequate mechanical stability, a version of the invention the jacket has a reinforcing layer at its exterior for the radiation-impermeable material that can be formed of a light metal, for example aluminum, or preferably a fiber-reinforced polymeric material, for example Durethan®, which is joined surface-wide with the protective material, so that a composite material is formed.

DESCRIPTION OF THE PREFERRED EMBODIMENTS

Figure 1:
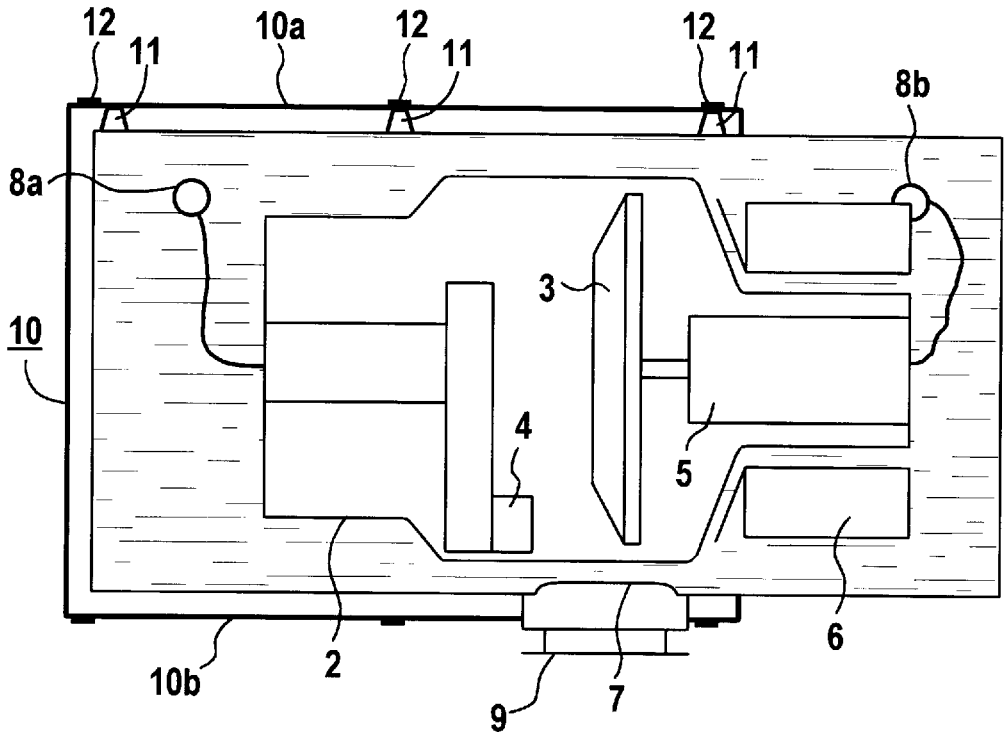
FIG. 1 shows an inventive X-radiator in longitudinal section.
Figure 2:
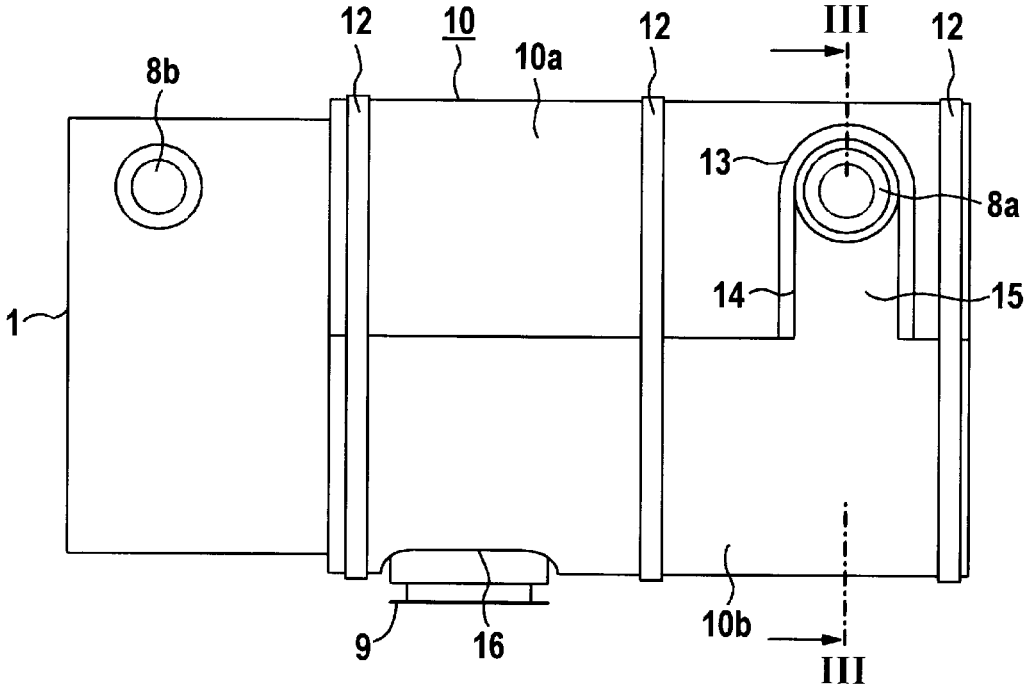
FIG. 2 is a section along the line II—II in FIG. 1.
Figure 3:
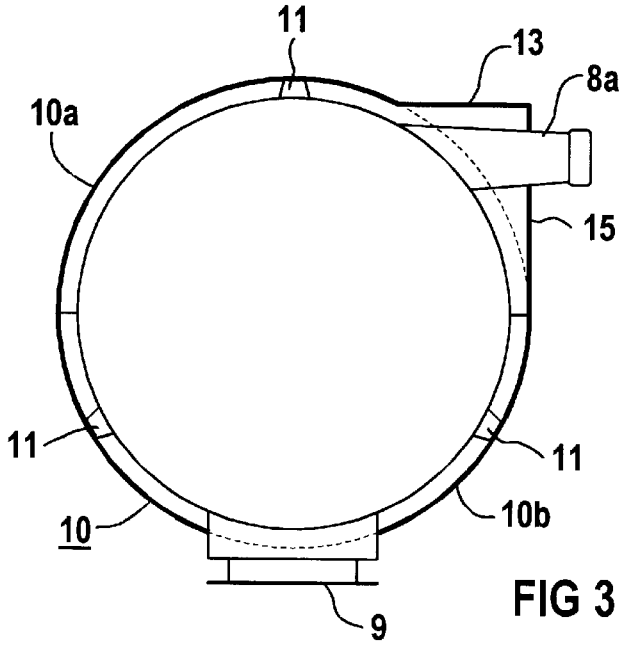
FIG. 3 is a view in the direction of the arrow III in FIG. 2.

FIGS. 1 through 3 show an inventive X-radiator that has a housing 1 that is filled with an electrically insulating fluid, for example insulating oil, and in which an X-ray tube 2 is arranged. The X-ray tube 2 in this embodiment is a rotating anode X-ray tube that contains a rotating anode assembly with an anode dish 3, a cathode 4 and a motor for driving the rotating anode assembly. The motor is formed by a rotor 5 and a stator 6 arranged outside the vacuum housing of the X-ray tube 2. The housing 1 is provided with a beam exit window for the X-radiation emanating from the anode dish 3.

The voltages required for the operation of the X-ray tube 2 are supplied thereto via two high-voltage terminals 8*a* and 8*b* and lines that are schematically indicated in FIG. 1.

In order to be able to connect the X-radiator to a primary radiation diaphragm (not shown), the housing 1 is provided with a flange 9 in the region of the beam exit window 7.

For reasons of radiation protection, the substantially cylindrically fashioned housing 1 is surrounded by a jacket 10 that contains at least one protective substance. The jacket 10 is generally adapted in shape to the shape of the housing 1, and therefore has an approximately cylindrical, pot-shaped form. The jacket 10 surrounds the housing 1 except in the region lying at the right in FIG. 1, in which the anode dish 3 assumes the function of radiation protection.

As can be seen from FIGS. 1 through 3, the jacket 10 is formed of a number of parts, namely it is divided into two half shells 10*a* and 10*b* with interposed suitable spacers 11, which can, for example, be rubber buffers. The jacket 10 is releasably held at the exterior of the housing 1 by holders in the form of clamping straps 12, so that the jacket 10 can be completely removed from the housing 1.

The half shell 10*a* has a bulge 13 in the region of the high-voltage terminal 8*a* that is provided with a slot 14 through which the high-voltage terminal 8*a* extends.

The remaining region of the slot 14 is closed by a clip 15 attached to the half shell 10*b*. The half shell 10*b* also has an opening 16 through which the flange 9 extends.

Figure 4:
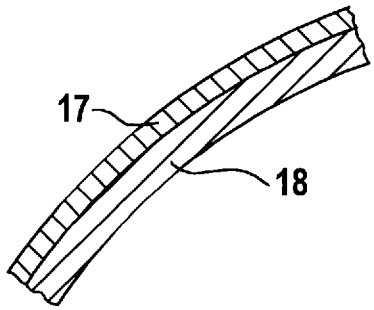
FIG. 4 shows a detail of the X-radiator according to FIGS. 1 in an enlarged, sectional view.

Since lead or a lead alloy or lead rubber, i.e. a soft material with little mechanical stability is used as the protective substance 18, the jacket 10 has a reinforcing layer 17 at its exterior that surrounds the protective substance 18, as can be seen from FIG. 4. The reinforcing layer 17 can be formed of a light metal, for example aluminum or an aluminum alloy, but is preferably formed of a fiber-reinforced, polymeric material, for example Durethan®.

The protective layer 17 and the protective substance 18 are joined surface-wide to one another, for example by gluing.

Although in the described exemplary embodiment the jacket 10 is divided into two half shells, it is also possible to divide the jacket 10 into more than two parts, or to completely forego a division of the jacket 10.

Since a gap, which can also be produced differently than on the basis of rubber buffers 11, is present between the exterior of the protective housing 1 and the jacket 10, it is not necessary to adapt the inside of the jacket 10 precisely to the shape of the exterior of the protective housing 1. On the contrary, the jacket 10 can exhibit a geometrically simple design, such as a pot-shaped design, as in the case of the described exemplary embodiment.

Although the X-ray tube 2 contained in the X-radiator in the described exemplary embodiment is a rotating anode X-ray tube, a fixed anode X-ray tube can be provided instead.

Although modifications and changes may be suggested by those skilled in the art, it is the intention of the inventors to embody within the patent warranted hereon all changes and modifications as reasonably and properly come within the scope of their contribution to the art.

We claim as our invention:

1. An X-ray radiator comprising:

a housing having a first end and a second end disposed opposite each other;

an X-ray tube contained in aid housing between said first and second ends, said X-ray tube containing a rotatable anode and emitting X-rays from said rotatable anode;

an X-ray protective cladding comprising a jacket surrounding an exterior of said housing and containing at least one substance which substantially impedes X-ray propagation through said jacket, said jacket covering only a portion of said exterior of said housing, said jacket covering said first end and extending from said first end substantially to a location of said rotatable anode, leaving a remaining portion of said housing uncovered by said jacket; and means for attaching said jacket to said exterior of said housing for permitting complete removal of said jacket from said housing.

2. An X-ray radiator as claimed in claim 1 wherein said means for attaching comprises a plurality of spacers holding said jacket a distance from said exterior of said housing.

3. An X-ray radiator as claimed in claim 1 wherein said jacket comprises a plurality of separable jacket parts.

4. An X-ray radiator as claimed in claim 3 wherein said jacket comprises two half shells.

5. An X-ray radiator as claimed in claim 1 wherein said substance comprises lead.

6. An X-ray radiator as claimed in claim 1 wherein said jacket comprises a reinforcing layer for said substance.

7. An X-ray radiator as claimed in claim 5 wherein said reinforcing layer comprises a light metal.

8. An X-ray radiator as claimed in claim 6 wherein said reinforcing layer comprises a polymeric material.

9. An X-ray radiator as claimed in claim 5 wherein said reinforcing layer is joined to said protective substance surface-wide.

10. An X-ray radiator as claimed in claim 1 wherein said X-ray tube comprises an X-ray tube housing having a first X-ray tube housing portion having a first diameter for accommodating said rotatable anode, and having a second X-ray tube housing portion having a second diameter which is less than said first diameter, said X-ray tube housing having a transition region between said first X-ray tube portion and said second X-ray tube portion, and wherein said jacket covers only a portion of said exterior of said housing at said first end and extending from said first end to a location of said transition region of said X-ray tube housing.

* * * * *